United States Patent [19]

Creighton et al.

[11] Patent Number: 5,050,621

[45] Date of Patent: Sep. 24, 1991

[54] SMOKING ARTICLES

[75] Inventors: David E. Creighton, Ashurst; Colin C. Grieg, Salisbury, both of England

[73] Assignee: British-American Tobacco Company Limited, London, England

[21] Appl. No.: 380,385

[22] Filed: Jul. 17, 1989

[30] Foreign Application Priority Data

Aug. 12, 1988 [GB] United Kingdom ..... 8819291

[51] Int. Cl.[5] ..... A24D 1/00; A24D 1/18; A24D 3/06

[52] U.S. Cl. ..... 131/331; 131/332; 131/333; 131/334; 131/194; 131/195

[58] Field of Search ..... 131/194, 195, 331, 332, 131/333, 334

[56] References Cited

U.S. PATENT DOCUMENTS 3,368,566 2/1968 Avedikian ..... 131/331

FOREIGN PATENT DOCUMENTS 0174645 3/1986 European Pat. Off. ..... 131/194

*Primary Examiner*—V. Millin

*Attorney, Agent, or Firm*—Kane, Dalsimer, Sullivan, Kurucz, Levy, Eisele and Richard

[57] ABSTRACT

There is provided a smoking article comprising a heating unit, aerosol generation section in flow communication at a first end thereof with said heating unit, nicotine source in flow communication at a first end thereof with the heating unit, a mixing space with which said aerosol generation section and nicotine source means are in flow communication at or via respective second ends thereof, and a velocity accelerating orifice in flow communication with the mixing space.

21 Claims, 1 Drawing Sheet

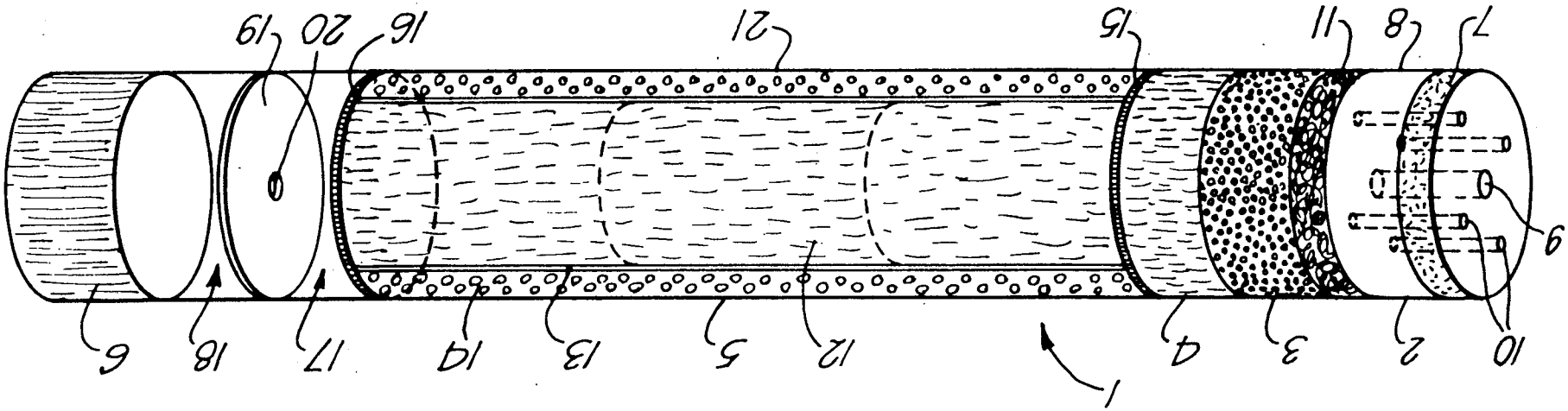
9
10
7
8
2
11
3
4
15
1
12
21
5
13
14
16
20
17
19
18
6

SMOKING ARTICLES

BACKGROUND OF THE INVENTION

2. Field of the Invention

The invention the subject of the present application relates to smoking articles.

2. Brief Description of the Prior Art

Proposals have been put forth for smoking articles which in use deliver an aerosol or vapour instead of or in conjunction with smoke from combusted tobacco and/or other smoking material. Such smoking articles may be referred to as "aerosol generation smoking articles".

Details of prior proposed aerosol generation smoking articles are to be found in United Kingdom Patent Specifications Nos. 1,033,674 and 1,083,761 (Battelle Memorial Institute). Other prior proposed aerosol generation smoking articles are disclosed in U.S. Patent Specification No. 4,714,082 (R. J. Reynolds Tobacco Company).

SUMMARY OF THE INVENTION

It is an object of the subject invention to provide improved aerosol generation smoking articles.

According to one aspect of the subject invention there is provided a smoking article comprising a heating unit, aerosol generation means in flow communication at a first end thereof with said heating unit, nicotine source means in flow communication at a first end thereof with said heating unit, a mixing space with which said aerosol generation means and said nicotine source means are in flow communication at or via respective second ends thereof, and a velocity accelerating orifice in flow communication with said mixing space.

Conveniently, the velocity accelerating orifice takes the form of one or more openings of small section in a member, advantageously of plate form, bounding the mixing space. Advantageously, the orifice is disposed at an end of the mixing space opposite the second ends of the aerosol generation means and the nicotine source means.

Preferably, the velocity accelerating orifice opens into a second space.

It is to be understood that although it is preferable for the mixing space and, if present, the second space, to be empty, it is conceivable that one or both of these spaces may contain a loosely packed material.

According to another aspect of the subject invention there is provided a smoking article comprising a heating unit, a catalytic unit in gas flow communication with said heating unit, nicotine source means in gas flow communication with said catalytic unit, and/or aerosol generation means in gas flow communication with said catalytic unit.

The catalytic unit preferably comprises a material possessing catalytic activity for the oxidation of carbon monoxide to carbon dioxide. The material may be copper oxide, manganese dioxide or a mixture of both of these. A method of production of a manganese dioxide catalyst for the oxidation of carbon monoxide in tobacco smoke is disclosed in United Kingdom Patent Specification No. 1,315,374 (B.A.T). Suitably, the catalytic material is present in the catalytic unit together with a water binding agent such as silica gel.

The exothermic oxidation reaction of carbon monoxide to carbon dioxide effected by the catalytic unit provides additional heat to gases passing through the catalytic unit from the heating unit.

According to a further aspect of the subject invention there is provided a smoking article comprising a heating unit, alkali source means in gas flow communication with said heating unit, nicotine source means in gas flow communication with said alkali source means, and aerosol generation means in gas flow communication with said heating unit.

Preferably, the aerosol generation means is in gas flow communication with the heating unit via the alkali source means.

The alkali source means advantageously comprises a substrate, paper for example, carrying an alkali source material, ammonium carbonate, ammonium bicarbonate or ammonium acetate for example.

The aerosol generation means may, in this aspect of the invention, alternatively or in addition comprise an acid, aqueous hydrochloric or acetic acid for example, which acid is reactable with the alkali material to produce micro-crystals which serve as aerosol formation nuclei.

In smoking articles in accordance with the first above defined aspect of the subject invention respective gas flow paths through the aerosol generation means and the nicotine source means are preferably substantially coterminous. In smoking articles in accordance with either of the other two above defined aspects of the subject invention, the respective gas flow paths through the aerosol generation means and the nicotine source means may, instead of being in parallel arrangement, be arranged sequentially. If the aerosol generation means and the nicotine source means are arranged sequentially, either can be disposed closer the heating unit. In smoking articles in accordance with any of the above defined aspects of the subject invention an advantageous arrangement of the aerosol generation means and the nicotine source means is for one of these to be disposed annularly about the other.

In smoking articles in accordance with any of the above defined aspects of the subject invention the heating unit advantageously comprises an ignition portion and a fuel portion. The ignition portion of the heating unit preferably comprises carbonaceous material and a combustion promoter and may also comprise a binder material. The combustion promoter may suitably be potassium nitrate or potassium chlorate, for example. The binder material may be starch, carboxymethyl cellulose or other suitable material. Advantageously the carbonaceous material takes the form of powdered carbon. The fuel portion is also advantageously comprised of carbonaceous material, which material may take the form of powdered carbon, and a suitable binder material, such as mentioned above. Other inorganic burn control materials such as perlite and chalk, for example, may also with advantage be present in the fuel portion. The fuel portion may also further comprise a combustion promoter, such as described above, but at a percentage inclusion level less than that of the ignition portion. The heating unit is preferably provided with one or more gas flow passages which extend through the heating unit to aid in the transfer of heat to the aerosol generation means. The heating unit may further, with advantage, be provided with a gas pervious fire break.

The aerosol generation means in each aspect of the invention preferably comprises a substrate, such as particulate vermiculite, magnesium silicate or carbon, carrying an aerosol generating substance, such as propylene glycol, glycerol, triethylene glycol or mixtures thereof, which substance is liberated by heat.

Preferably the nicotine source means takes the form of a tobacco-containing section. It is to be understood that the nicotine source means may comprise a sensorily perceived compound(s) in addition to, or in replacement of, nicotine.

Preferably, smoking articles in accordance with the subject invention are of dimensions similar to those of conventional cigarettes and may also comprise a tobacco smoke filtration material, such as cellulose acetate or other suitable materials, at the mouth end thereof.

BRIEF DESCRIPTION OF THE DRAWING

In order that the subject invention may be clearly understood and readily carried into effect, reference will now be made, by way of example, to the diagrammatic drawing hereof, which shows a smoking article partly in section and with part of an outer wrapper removed.

DETAILED DESCRIPTION OF THE DRAWING

The smoking article shown in the drawing, which is an aerosol generation smoking article and which is designated generally by reference numeral 1, comprises, at a forward end thereof, a heating unit 2. Sequentially arranged behind the heating unit 2, in a direction towards the mouth end of the smoking article 1, are a catalytic unit 3, an alkali source means 4, an aerosol element 5 and a mouthpiece 6.

The heating unit 2 comprises a forwardly disposed ignition block 7 of disc configuration, which block 7 is composed of powdered carbon, a binder such, for example, as starch or carboxymethyl cellulose, and a combustion promoter such, for example, as potassium nitrate or potassium chlorate. The heating unit 2 further comprises a cylindrical fuel block 8 composed of powdered carbon and a binder. The fuel block 8 may also comprise a combustion promoter, although at a percentage inclusion level less than that of the ignition block 7. A central gas flow passage 9 and four peripheral gas flow passages 10, of lesser diameter than the passage 9, extend between, and open at, the forward face of the block 7 and the rear face of the block 8.

Also forming part of the heating unit 2 is a gas pervious fire break 11. The fire break 11, which is of disc configuration and is disposed to the side of the block 8 remote the block 7, is formed of, for example, mineral wool or vermiculite.

The catalytic unit 3 comprises a gas pervious cylindrical body of particulate copper oxide in admixture with particulate manganes dioxide and silica gel.

The alkali source means 4 comprises a gas pervious cylindrical body of paper loaded with ammonium carbonate.

The aerosol element 5 comprises a gas pervious cylindrical body 12 of cut tobacco, which body 12 is wrapped in a gas impervious wrapper 13, and a gas pervious annular layer 14 comprised of a particulate substrate of, for example, vermiculite or magnesium silicate, treated with propylene glycol and glycerol. The body 12 of cut tobacco provides nicotine source means and the layer 14 provides an aerosol generation means. The aerosol element 5 further comprises, at forward and rearward ends respectively of body 12 and layer 14, gas pervious retainer discs 15 and 16. The aerosol element 5 also comprises, at the rearward end thereof, a mixing space 17 and a distribution space 18, the space 17 being to the forward side of a transversely disposed plate 19 and the space 18 being to the rearward side of the plate 19. Disposed at the centre of the plate 19 is a circular opening 20 of 0.5 to 1.0 mm diameter, which opening 20 provides a velocity accelerating orifice.

The mouthpiece 6 takes the form of a gas pervious plug of fibrous cellulose acetate.

Items 2 to 6 of smoking article 1 are wrapped in a gas impervious wrapper 21.

In use of smoking article 1, after lighting the ignition block 7 the user draws on the smoking article 1 from the mouth end thereof, thus causing ambient air to flow into the passages 9 and 10 of the heating unit 2. Heated air and hot combustion gases flow sequentially through the fire break 11, the catalytic unit 3, the alkali source means 4 and, in parallel flow paths, through the body 12 of cut tobacco and the annular layer 14.

In passing through the catalytic unit 3 the gases are further heated as a result of the exothermic oxidation reaction of carbon monoxide in the gases to carbon dioxide.

In the passage thereof through the alkali source means 4 the gases pick up ammonia, the presence of which in the gases enhances the mechanisms whereby the gases pick up nicotine from the body 12 of cut tobacco and propylene glycol and glycerol from the layer 14.

As the propylene glycol/glycerol aerosol and the nicotine pass, at elevated velocity, through the opening 20 in the plate 19 nicotine vapour condenses into combination with particles of propylene glycol and glycerol, the opening 20 acting as a capillary press. Thus the user draws from the mouthpiece 6 an aerosol comprising nicotine.

If a volatile flavorant material is deposited at the body 12 of cut tobacco and/or at the layer 14, the aerosol which flows through the space 18 may contain also the flavorant material in the particulate phase of the aerosol.

If hydrochloric acid is deposited at the aerosol element 5, ammonia will react therewith to form a fog of micro-crystals of ammonium chloride, which microcrystals serve as nuclei in the formation of the propylene glycol/glycerol aerosol. Conveniently, the hydrochloric acid or a source thereof, is deposited at the layer 14, in which case it is advantageous that the arrangement is such that ammonia flows through the body 12 of cut tobacco, but not through the layer 14, whereby hydrogen chloride and ammonia do not come into mutual contact until each reaches the mixing space 17. It may thus be the case that the alkali source means is so dimensioned and disposed as to be in flow communication with the body 12 of cut tobacco, but not to be in flow communication with the layer 14.

What is claimed is:

1. A smoking article, which comprises; a heating unit; aerosol generation means having a first end and a second end, said first end being in flow communication with said heating unit; nicotine source means having a first end and a second end, the first end of the nicotine source means being in flow communication with said heating unit; a mixing space in flow communication with said second end of the aerosol generation means and in flow communication with the second end of said nicotine source means; a velocity accelerating orifice in flow communication with the downstream end of said mixing space; and a catalytic unit for the oxidation of carbon monoxide to carbon dioxide, in gas flow communication with said heating unit and with said nicotine source means and located intermediate said heating unit and said nicotine source means.

2. A smoking article according to claim 1, wherein said smoking article further comprises alkali source means located downstream of said heating unit.

3. A smoking article according to claim 1, wherein said nicotine source means comprises a section of tobacco material.

4. A smoking article according to claim 1, wherein said nicotine source means comprises a sensorily perceived compound other than nicotine.

5. A smoking article, which comprises; a heating unit; aerosol generation means having a first end and a second end, said first end being in flow communication with said heating unit; nicotine source means having a first end and a second end, the first end of the nicotine source means being in flow communication with said heating unit; a mixing space in flow communication with said second end of the aerosol generation means and in flow communication with the second end of said nicotine source means; a velocity accelerating orifice in flow communication with the downstream end of said mixing space; and alkali source means located intermediate said heating unit and said nicotine source means.

6. A smoking article, which comprises; a heating unit, a catalytic unit in gas flow communication with said heating unit, and nicotine source means in gas flow communication with said catalytic unit; and wherein said catalytic unit further comprises a water binding agent.

7. An article of claim 6 which further comprises aerosol generation means in gas flow communication with said catalytic unit.

8. A smoking article according to claim 6, wherein said catalytic unit comprises a material possessing catalytic activity for the oxidation of carbon monoxide to carbon dioxide.

9. A smoking article according to claim 8, wherein said material is one or both of copper oxide and manganese dioxide.

10. A smoking article, which comprises; a heating unit, a catalytic unit in gas flow communication with said heating unit, and nicotine source means in gas flow communication with said catalytic unit; and wherein said smoking article further comprises a velocity accelerating orifice located downstream of said nicotine source means.

11. A smoking article comprising a heating unit, alkali source means in gas flow communication with said heating unit, nicotine source means in gas flow communication with said alkali source means, and aerosol generation means in gas flow communication, wherein said aerosol generation means is in gas flow communication with said heating unit via said alkali source means.

12. A smoking article comprising a heating unit, alkali source means in gas flow communication with said heating unit, nicotine source means in gas flow communication with said alkali source means, and aerosol generation means in gas flow communication with said heating unit; and wherein said alkali source means comprises a substrate carrying an alkali source material which is one or more of ammonium carbonate, ammonium bicarbonate and ammonium acetate.

13. A smoking article comprising a heating unit, alkali source means in gas flow communication with said heating unit, nicotine source means in gas flow communication with said alkali source means, and aerosol generation means in gas flow communication with said heating unit, wherein said aerosol generation means comprises an acid.

14. A smoking article comprising a heating unit, alkali source means in gas flow communication with said heating unit, nicotine source means in gas flow communication with said alkali source means, and aerosol generation means in gas flow communication with said heating unit, wherein said smoking article further comprises a catalytic unit located intermediate said heating unit and said nicotine source means.

15. A smoking article comprising a heating unit, alkali source means in gas flow communication with said heating unit, nicotine source means in gas flow communication with said alkali source means, and aerosol generation means in gas flow communication with said heating unit and wherein said smoking article further comprises a velocity accelerating orifice located downstream of said aerosol generation means.

16. A smoking article comprising a heating unit, alkali source means in gas flow communication with said heating unit, nicotine source means in gas flow communication with said alkali source means, and aerosol generation means in gas flow communication with said heating unit and, wherein the gas flow paths through said aerosol generation means and said nicotine source means are in sequential arrangement.

17. A smoking article, which comprises; a heating unit; aerosol generation means having a first end and a second end, said first end being in flow communication with said heating unit; nicotine source means having a first end and a second end, the first end of the nicotine source means being in flow communication with said heating unit a mixing space in flow communication with said second end of the aerosol generation means and in flow communication with the second end of said nicotine source means; a velocity accelerating orifice in flow communication with the downstream end of said mixing space; and wherein one of said aerosol generation means and said nicotine source means is disposed annularly about the other.

18. A smoking article according to claim 17, wherein said velocity accelerating orifice takes the form of one or more openings of small section in a member bounding said mixing space.

19. A smoking article according to claim 18, wherein said member is of plate form.

20. A smoking article according to claim 17, wherein said velocity accelerating orifice opens into a second space.

21. A smoking article, which comprises; a heating unit; aerosol generation means having a first end and a second end, said first end being in flow communication with said heating unit; nicotine source means having a first end and a second end, the first end of the nicotine source means being in flow communication with said heating unit; a mixing space in flow communication with said second end of the aerosol generation means and in flow communication with the second end of said nicotine source means; a velocity accelerating orifice in flow communication with the downstream end of said mixing space; and alkali source means located intermediate said heating unit and said nicotine source means.

* * * * *